US008669879B2

(12) United States Patent
Sullivan et al.

(10) Patent No.: US 8,669,879 B2
(45) **Date of Patent: *Mar. 11, 2014**

(54) MEDICAL DEVICE READINESS ALERT INCLUDING POWER CONSERVATION

(71) Applicant: Physio-Control, Inc., Redmond, WA (US)

(72) Inventors: Joseph L. Sullivan, Kirkland, WA (US); Benjamin A. Flugstad, Port Ludlow, WA (US); Glenn Morita, Lynnwood, WA (US)

(73) Assignee: Physio-Control, Inc., Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/732,254

(22) Filed: Dec. 31, 2012

(65) Prior Publication Data

US 2013/0127624 A1 May 23, 2013

Related U.S. Application Data

(63) Continuation of application No. 12/897,042, filed on Oct. 4, 2010, now Pat. No. 8,344,899.

(51) Int. Cl.
*G08B 21/00* (2006.01)

(52) U.S. Cl.
USPC ..... 340/635; 340/636.1; 340/384.1; 340/691.3

(58) Field of Classification Search
USPC ..... 340/636.1, 384.1–384.72, 691.1–692, 340/635
See application file for complete search history.

(56) References Cited

U.S. PATENT DOCUMENTS 4,065,767 A * 12/1977 Neuhof et al. ..... 340/384.4
7,570,994 B2 * 8/2009 Tamura et al. ..... 607/5

* cited by examiner

*Primary Examiner* — Jeffery Hofsass
(74) *Attorney, Agent, or Firm* — Marger Johnson & McCollom PC

(57) ABSTRACT

Techniques are provided for alerting a person to check a medical device while conserving battery power. The medical device initiates a status alert if a readiness condition of the medical device is no longer being met. The status alert includes notification periods during which an audible sound is emitted alternating with off periods during which substantially no audible sound is emitted. The audible sounds may include certain tones or at least one spoken word. At least one of the duration of successive notification periods or the duration of successive off periods may be varied. In this manner, the medical device may provide audible sound at different times during the day in an attempt to get the attention of a person. In addition, the medical device may sense an activity to determine when to provide the audible sound.

20 Claims, 8 Drawing Sheets

MEDICAL DEVICE READINESS ALERT INCLUDING POWER CONSERVATION

TECHNICAL FIELD

This disclosure relates to medical devices and, more particularly, to medical device power management.

BACKGROUND

A variety of different medical devices may be used to monitor and/or provide therapy to a patient experiencing a medical condition. As these medical devices become increasingly automated, different individuals, from trained medical professionals to untrained bystanders, are able to use the medical devices in an emergency situation, thus increasing the utility of the devices. In recognition of the growing utility of different medical devices, various public and private venues are receiving medical devices to ensure that the devices are readily available in case of a medical emergency. In different examples, the medical devices may be stored on a wall, in a closet, or on a shelf for easy access in case medical treatment is needed.

An example of an emergency medical device is an external chest compression machine, such as is currently manufactured by Jolife, and distributed in the United States by Physio-Control, Inc. Another example of an emergency medical device would be a CPR-assist device, which can emit prompts for a user to assist the user in delivering CPR at proper time intervals.

An automated external defibrillator (AED) is one more example of a medical device that is increasingly prevalent in public settings and even private homes. An AED can provide lifesaving treatment to a patient in cardiac arrest. In general, when a patient is suffering from cardiac arrest, electrodes from the AED are placed on the patient's chest and an electrical shock is applied to depolarize the patient's heart and restore normal sinus rhythm. In some examples, a battery provides a stored charge that supplies the electrical shock necessary to restore the patient's normal heart rhythm. When not in use, the battery is generally stored in a charged state to ensure that the AED readily available if a medical emergency arises. If the battery deteriorates such that the battery is no longer able to provide a sufficient electrical shock in an emergency, lifesaving treatment may be delayed until a replacement battery or replacement AED is obtained. Similarly, if other maintenance is required before the AED can deliver an electrical shock, treatment may be delayed until maintenance is performed or a replacement device is obtained.

SUMMARY

The disclosure is generally directed to techniques for alerting a person to check a medical device. Because a medical device may be used infrequently, an individual may forget to periodically check the medical device for any problems that arise. A failure to detect or address a problem may render the medical device ineffective during a medical emergency.

To alert the person, the medical device may include a variety of visual, audible, and/or tactile indicators that are activated in response to various conditions including, for example, a low battery condition, a maintenance problem, or even according to a routine maintenance schedule. In some circumstances, an audible alert may be more effective at drawing a person's attention to a medical device than other types of alerts. However, an audible alert may draw excessive amounts of battery power, particularly if the audible alert is not detected and silenced in a reasonable period of time. Other types of alerts may also draw excessive amounts of power if not detected in a reasonable period of time. Accordingly, techniques are provided in this disclosure for power conserving alerts for medical devices.

In one example according to the disclosure, a medical device meeting a readiness condition for use in a patient emergency is described. The medical device is intended to be stored at a storage location. The medical device includes a battery, a sound producer powered by the battery, and a processor powered by the battery. The processor is configured to determine whether the readiness condition is no longer met after being met for at least a certain time period, and to cause, in response to so determining, the sound producer to emit a status alert for attracting the attention of a person close to the storage location. According to the example, the status alert includes notification periods during which an audible sound is emitted alternating with off periods during which substantially no audible sound is emitted, the off periods lasting at least 10 minutes each, and the durations of two successive off periods being unequal to each other.

In some examples, the medical device also includes an emergency speaker distinct from the sound producer, and the processor is further configured to cause audible prompts to be emitted via the emergency speaker for helping the user perform Cardio Pulmonary Resuscitation on the patient according to these prompts.

In some examples, the medical device also includes a sensing circuit for sensing activity indicating that a passerby is close to the storage location during the certain time period. In these examples, the processor registers times of the day that the passerby is indicated as being close to the storage location, and the alert times are derived from the times of the day.

The details of one or more examples are set forth in the accompanying drawings and the description below. Other features, objects, and advantages will be apparent from the description and drawings, and from the claims.

DETAILED DESCRIPTION

A medical device may be used infrequently, whether it is placed in a commercial setting or in a private household. As time passes, the effectiveness of the medical device may decrease as, for example, components degrade or a battery discharges. A user's familiarity with the medical device may also decrease as time passes unless the user takes steps to maintain competency with the device. To forgo these various issues, the medical may be configured to provide a status alert, prompting a person (e.g., an owner, an operator, a passerby, or a bystander) to check the medical device. In some examples, the status alert may indicate a problem, such as a partially discharged battery, that requires attention to ensure the integrity and operability of the medical device. In further examples, the status alert may indicate a maintenance or service schedule, for example, prompting the person to inspect the medical device, recharge the battery, or perform similar maintenance tasks. The status alert may also indicate that a training refresher course, such as a training course provided by the medical device, should be executed to maintain the proficiency of the user. Additional or different status alerts may be provided by the medical device.

In general, detection of a status alert is necessary before a person can act on the alerted condition. If a medical device alert is activated without a person in an alert proximity of the medical device, the medical device may continue alerting until a person subsequently enters the alert proximity of the medical device and silences the alert or otherwise attends to the alerted condition. Further, if the medical device is located in an isolated area, or if people are not present at the location where the device is stored, such as in an office building over a weekend or on a holiday, the medical device may continue alerting for an extended period of time before attention can directed to the status alert.

With some medical devices, a continuous alert may be acceptable provided that a person eventually detects and acts on the alerted condition. With other medical devices, however, a continuous alert may result in excessive power if an alert is not detected within a suitable time period after the status alert is initiated. For example, if a medical device includes a battery, an undetected status alert may drain the battery. A failure to detect or address a problem may render the medical device ineffective during a medical emergency.

In view of the advantages of detecting a status alert on a medical device and ensuring that a status alert operates long enough to be detected, the disclosure provides power conserving alerts for medical devices. Examples techniques for power conserving alerts for medical devices will be described in greater detail with reference to FIGS. 4-8. However, conceptual details for example medical devices will first be described with reference to FIGS. 1-3.

Figure 1:
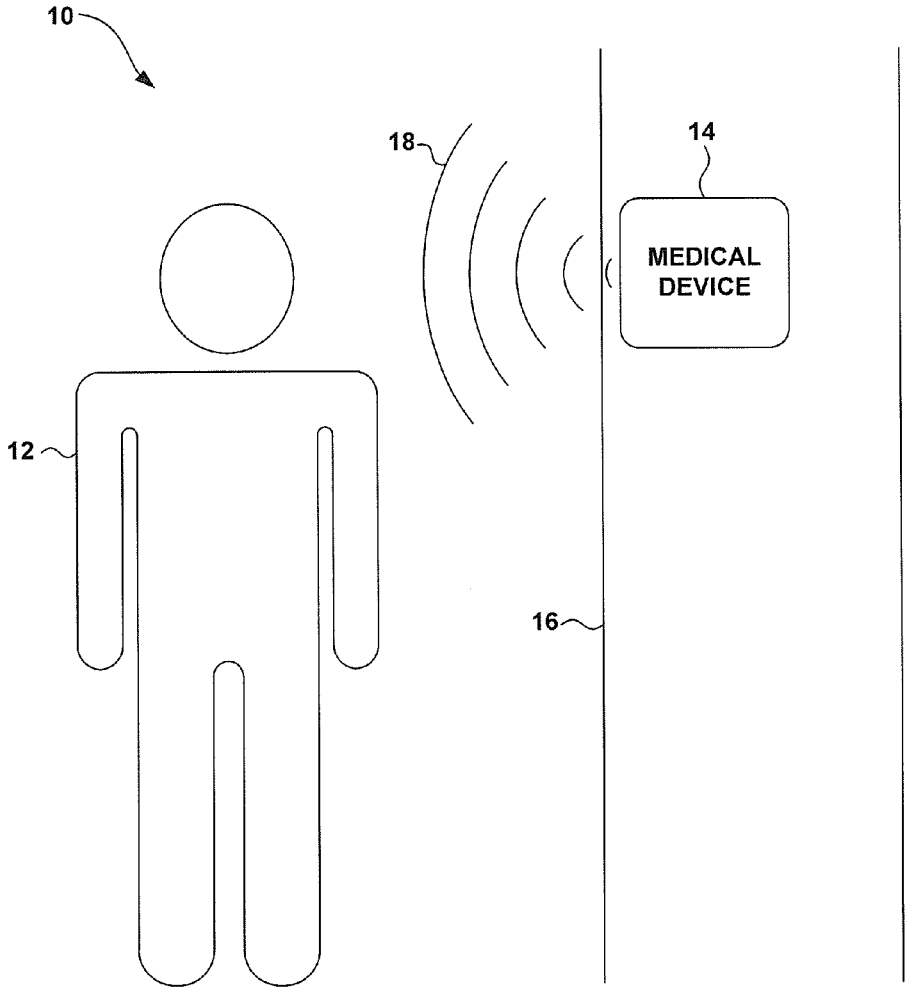
FIG. 1 is a conceptual diagram illustrating an example system that includes a stored medical device that provides a status alert to a person according to embodiments.

FIG. 1 is a conceptual diagram illustrating an example system that includes an example medical device that provides a status alert to a person. As shown in FIG. 1, system 10 includes person 12, a medical device 14, wall 16, and status alert 18. Device 14 is stored in a storage location, which in the example of FIG. 1 is wall 16, to facilitate easy access for a user during a patient emergency. Device 14 may be used by a user, who may be any person, such as a trained emergency medical technician or an untrained bystander. Person 12 may be a person that detects status alert 18 and, as such, may be a passerby, a bystander, a user of device 14, or any other person close to a storage location of device 14. Wall 16 may be located in private setting such as the home of person 12 or a public setting such as a hospital or a clinic.

In other embodiments, device 14 is not simply mounted on a wall, but instead provided on a docking station that is on the wall. Device 14 may be exposed, or the docking station provides an enclosure, such as a cabinet. If an enclosure is provided, then preferably it has an opening or other arrangement for the alert emitted by device 14 to be perceived by person 12.

Device 14 may remain on wall 16 for weeks, months, or years at a time without being used by a user because medical emergencies, such as a life threatening cardiac arrhythmias, generally occur infrequently. To ensure that device 14 is ready to be used if a patient emergency should arise, device 14 may be stored in a readiness condition during this time. However, even though device 14 may initially meet the readiness condition when placed at a storage location, device 14 may not meet the readiness condition after a certain period of time. Further, person 12 may forget to periodically check the status of device 14 to determine if one or more readiness conditions of device 14 are no longer being met. Accordingly, device 14 may include one or more status alerts that function to draw the attention of person 12 to device 14. The alert is so as to cause person 12 to act, for the readiness condition to become met again.

As will be described in greater detail below, device 14 may include a sound producer to emit status alert 18 for attracting the attention of person 12. In some examples, device 14 may determine whether a readiness condition is no longer met after being met for at least a certain time period. In some additional examples, device 14 may perform a diagnostic check to determine whether the readiness condition is no longer met. Status alert 18 emitted from device 14 may include notification periods during which an audible sound is emitted alternating with off periods during which substantially no audible sound is emitted. In some examples, no audible sound is emitted during an off period of status alert 18. In some additional examples, the durations of two successive off periods of status alert 18 may be unequal to each other. In this manner, device 14 may provide audible sound at varying times to attract the attention of person 12 while conserving the power of device 14.

Device 14 may determine whether a readiness condition of device 14 is no longer being met after being met for at least a certain period of time while being stored at the storage location and, in response to determining that the readiness condition is no longer being met, cause a sound producer to emit status alert 18 for attracting the attention of person 12. In general, device 14 is intended for use in a patient emergency, and a readiness condition may be condition related to whether device 14 is suitable for the intended use in the patient emergency. If the readiness condition is met, device 14 may be considered suitable or ready for use in a patient emergency. If the readiness condition is not met, device 14 may require user attention or other action before device 14 may be considered fully ready for use in a patient emergency. Generally speaking though, unless a readiness condition is a critical readiness condition that prevents device 14 from operating during a patient emergency, device 14 may still be operable during a patient emergency even if a readiness condition is not met. In some examples, a readiness condition may relate to a condition of a potential user of device 14 such as, e.g., a training status of a potential user of device 14. A training status may indicate whether a potential user has trained on device 14 recently enough to be familiar with the operation of device 14 during a patient emergency. In other examples, a readiness condition may relate to a condition of device 14 such as, e.g., a hardware or software condition of device 14. In these examples, a readiness condition may indicate whether device 14 will provide an efficacious therapeutic output during a patient emergency.

In one example, a readiness condition may be a component of device 14 not malfunctioning. Device 14 may monitor the component and detect whether or not the component is malfunctioning during a routine diagnostic check. In another example, a readiness condition may be a scheduled service interval not having passed. A routine service schedule may be recommended for device 14, e.g., to check the operability of device 14. The service schedule may be stored in a memory of device 14, and device 14 may receive user input after performing the routine service. If device 14 does not receive user input indicating that service has been performed according to the schedule, device 14 may determine that a scheduled service interval has passed.

In still another example, a readiness condition may be that device 14 has a battery charge that is higher than a threshold. Device 14 may determine a charge of the battery of device 14, e.g., by testing the battery or querying the battery, and compare the charge to one or more thresholds stored in a memory of device 14. An example threshold may be 90 percent of full charge, 75 percent of full charge, 50 percent of full charge, or 25 percent of full charge. Other thresholds are possible though.

In yet another example, a readiness condition may be a training refresher course for using device 14 not having become due. Training refresher courses may be recommended, e.g., according to a schedule stored in a memory of device 14, for potential users of device 14. Device 14 may receive user input after performing a training refresher course to indicate that the training was completed. If device 14 does not receive user input indicating that a training refresher was performed according to the schedule, device 14 may determine that a training refresher became due. Alternatively, device 14 may provide a status alert before a training refresher date becomes due in order to prompt potential users to perform the training refresher course.

In still another example, a readiness condition may be a time not having passed that is associated with an expiration date of electrodes associated with device 14. An expiration date of electrodes associated with device 14 may be stored in a memory of device 14, and device 14 may determine if one or more of the electrodes are expired. Device 14 may include additional or different readiness conditions, and, in some examples, device 14 may determine that multiple readiness conditions are not met simultaneous.

In response to determining that a readiness condition is no longer being met, device 14 may emit status alert 18 for attracting the attention of person 12. Device 14 may monitor different readiness conditions and emit a status alert upon determining that a readiness condition is no longer being met. In some examples, device 14 may emit a status alert if a readiness condition is no longer being met independent of whether the readiness condition was ever met or whether the readiness condition was met for at least a certain period of time.

In other examples, however, device 14 may emit status alert 18 if a readiness condition is no longer met after being met for at least a certain time period. By determining whether a readiness condition is no longer met after being met for at least a certain time period, device 14 may avoid issuing unnecessary status alerts. For example, one or more hardware components of device 14 may be replaced or deliberately deactivated while service work is performed device 14. Device 14 may determine that a readiness condition is not being met during this time. However, service personnel may not want to be inundated with a status alert emitted from a sound producer while performing service work on device 14. Accordingly, device 14 may determine whether the readiness condition is no longer met after being met for at least a certain time period before emitting status alert 18.

In some examples, the certain period of time may comparatively short, such as between five minutes and one day. In other examples, the certain period of time may be comparatively longer, such as approximately one month. For example, the certain period of time may be between approximately five and approximately twenty-five days, such as, e.g., approximately fifteen days. Other periods of time are possible through for medical devices according to the disclosure.

Medical device 14 may determine whether a readiness condition of device 14 is no longer being met after being met for at least a certain period of time and, in response to determining that the readiness condition is no longer being met, emit status alert 18 for attracting the attention of person 12. Device 14 may emit an audible, visual, or tactile status alert, or combination of status alerts. As such, device 14 may include a speaker, a light, circuitry for creating vibration, or other hardware for generating a status alert. In some examples, device 14 may emit a status alert from a sound producer in addition to, or in lieu of, other types of status alerts because of the tendency of an audible status alert emitted from a sound producer to attract the attention of person 12. For example, device 14 in the example of FIG. 1 may provide audible status alert through a sound producer (not shown) to get the attention of person 12.

Once initiated, device 14 may provide a continuous status alert 18 such as an uninterrupted alert or an alert that exhibits an uninterrupted repeating pattern. Conversely, device 14 may provide a status alert 18 that is variable. For example, as described in greater detail below, device 14 may provide status alert 18 according to variable duty cycle. A variable duty cycle is an operating cycle that includes an active or "on" operating time and an inactive or "off" resting time. In some examples, a variable duty cycle includes multiple on and off operating periods. For example, status alert 18 may include notification periods during which an audible sound is emitted and alternating off periods during with substantially no sound is emitted. The duration of successive off periods such as, e.g., at least two successive off periods, may be unequal. In this way, device 14 may provide status alert 18 according to a variable duty cycle. Operating status alert 18 on a variable duty cycle may enable device 14 to use less battery power than operating status alert 18 on a continuous duty cycle (e.g., non-stop operation) because status alert 18 may be inactive for at least part of the period person 12 is not in the proximity of device 14 or fails to respond to status alert 18.

In general, providing status alert 18 according to a variable duty cycle in accordance with the techniques of this disclosure may involve activating status alert 18 such that an audible sound is emitted during each of a plurality of notification periods. Status alert 18 may also include off periods between the plurality of notification periods during which substantially no audible sound is emitted. For example, each notification period of the plurality of notification periods may be followed by an off period, which in turn is followed by a subsequent notification, and so on. The duration of different off periods may be unequal. In this manner, the frequency with which device 14 emits audible sound may vary. Varying the frequency with which device 14 emits audible sound may conserve power, e.g., to extend the overall duration of status alert 18 or to limit status alert 18 to periods when person 12 will most likely be within the proximity of device 14. As a result, the likelihood that person 12 will detect and act on an alerted condition may increase relative to an alert provided according to a continuous duty cycle. Addressing an alerted condition before a medical emergency arises may help ensure that device 14 is fully functional should such an emergency occur.

Device 14 may determine a duration of a notification period (i.e., a length of time that device 14 emits an audible sound) and a duration of an off period (i.e., a length of time between notification periods that device 14 emits substantially no audible sound). In some examples, the duration of successive notification periods may be substantially constant and the duration of successive off periods may vary. In other examples, the duration of successive notification periods may vary and the duration of successive off periods may be substantially constant. In still other examples, the duration of successive notification periods and the duration of successive off periods may vary.

In general, device 14 consumes more power when emitting audible sound during a notification period of status alert 18 than during an off period of status alert 18. As such, increasing the duration of an off period may reduce the power consumed by device 14. However, when status alert 18 is in an off period, device 14 may emit substantially no audible sound, thereby reducing the likelihood that person 12 will detect status alert 18. Thus, the duration of successive notifications periods and/or successive off periods of status alert 18 may vary based on a variety of factors in order to both conserve the power of device 14 and attract the attention of person 12. In one example, device 14 may determine random durations for successive off periods (or notification periods) of status alert 18. The duration of each consecutive off period may be randomly selected such that device 14 provides audible sound during a notification period of status alert 18 at random times. This technique may be successful in getting the attention of person 12 when person 12 is predicted to be periodically within the proximity of device 14. In another example, device 14 may progressively vary the duration successive off period (or notification period) of status alert 18. The duration each successive off period may be shorter than or equal to a previous off period, or longer than or equal to a previous off period. Progressive variation, as with random variation, may allow device 14 to provide audible sound during a notification period of status alert 18 at different times throughout a period of time. Providing audible sound at different times may, e.g., extend the overall duration of status alert 18 or increase the likelihood that person 12 will be within the proximity of device 14 during at least one of the notification periods of status alert 18.

Device 14 may vary the duration of successive off periods (or successive notification periods) of status alert 18 according to different techniques. According to another example, device 14 may vary the duration of successive off periods (or successive notification periods) of status alert 18 according to a schedule. The schedule may include intended alert times that dictate how status alert 18 is delivered. For example, the schedule may include predetermined times for the off periods of status alert 18 and/or predetermined times for the notification periods of status alert 18, thereby establishing the off periods and notification periods of status alert 18 once the alert is activated. The schedule may include predetermined times that are chosen based upon times that person 12 is predicted to be within an alert proximity of device 14 (i.e., within a proximity of device 14 that person 12 is expected to detect audible sound emitted by device 14). For example, the schedule may cause device 14 to provide the notification periods of status alert 18 at certain times during normal business hours. Alternatively, the schedule may cause device 14 to provide the notification periods of status alert 18 at certain times when person 12 is predicted to be at home. In another example, the schedule may cause device 14 to provide the notification periods more frequently during the day (e.g., between 7:00 AM and 7:00 PM) than during the night (e.g., between 7:00 PM and 7:00 AM) because of the increased likelihood that person 12 may be within an alert status of device 14 during the day than at night. In any event, the schedule can be configured to preclude device 14 from providing the notification periods of status alert 18 at times when person 12 is not predicted to be within the alert proximity of device 14. Preventing device 14 from delivering audible sound during the notification periods of status alert 18 at times when person 12 is not predicted to be within the alert proximity of device 14 may conserve power that would otherwise be used to provide the audible sound.

Independently of how device 14 establishes the duration of different notification periods or different off periods, the duration of a single notification period or the duration of a signal off period may, in some examples, be between approximately one minute and one day. Generally speaking, increasing the length of a single off period may reduce the amount of power consumed by device 14 when delivering status alert 18. As such, an off period of device 14 may, in some examples, last at least ten minutes, such as, e.g., at least one hour, at least two hours, or at least six hours. It should be appreciated, however, that the disclosure is not limited in this respect, and other lengths of time for an off period or a notification period of status alert 18 may be used.

In general, audible sound emitted during a notification period of status alert 18 is configured to attract the attention of person 12. Accordingly, audible sound emitted during a notification period of status alert 18 may include a variety of sounds that function to attract person 12. In some examples, audible sound emitted during a notification period of status alert 18 may be formed of a voice recording. In other examples, audible sound emitted during a notification period of status alert 18 may be formed from one or more bursts of tones. Audible sound emitted during a notification period of status alert 18 may be continuous or may include a plurality of separate sounds (e.g., words or tones) separated by short pauses (e.g., a pause between approximately 0.1 seconds and approximately 10 seconds between each sound of the plurality of sounds).

Where an audible sound emitted during a notification period of status alert 18 includes a burst of tones, the burst of tones may include one or more tones, where each tone has a frequency, volume, and length, and the burst includes one or more tones. In some examples, the frequency of a tone may be between approximately 20 Hz and approximately 20,000 Hz; the volume of a tone may be between approximately 10 and approximately 100 decibels (dB); and the length of a tone may be between approximately 10 milliseconds (ms) and approximately 10 seconds. Different frequencies, volumes and lengths are possible, however, and it should be appreciated that the disclosure is not limited in this respect. The burst may include identical tones, or the burst may include different tones where at least one of a frequency, length, or volume of one of the tones is varied with respect to at least one other tone in the burst of tones.

In some examples, a burst tones may be configured to be representative of a certain readiness condition of device 14, and device 14 may deliver different bursts of tones depending on the specific readiness condition that is no longer being met. For example, a first burst of tones may indicate that a battery of device 14 has a low charge while a second burst of tones may indicate that device 14 requires service.

An audible sound emitted during a notification period of status alert 18 may be sufficiently loud so as to attract the attention of person 12 if person 12 is close to the storage location of device 14. In some examples, an audible sound emitted during a notification period may exceed 60 decibels (db) when measured at a distance of one meter from a sound producer of device 14. By contrast, during an off period of status alert 18 when substantially no audible sound is emitted, an audible sound emitted from device 14 may, in some examples, not exceed 40 decibels (db) when measured at a distance of one meter from a sound producer of device 14.

As briefly described above, an audible sound emitted during a notification period of status alert 18 may include at least one spoken word, and in some cases multiple spoken words, captured on a voice recording that inform person 12 of a readiness condition of device 14. In different examples, the voice recording may tell person 12 to charge the battery of device 14, perform scheduled maintenance, replace a dysfunctional electrode, or perform other tasks associated with addressing the readiness condition identified by device 14. In addition to or in lieu of identifying a readiness condition of device 14 that is no longer being met, the voice recording may provide information to help or encourage person 12 to address status alert 18. For example, the at least one spoken word on the voice recording may instruct of a telephone number that person 12 can call. In another example, the voice recording may promise a reward to person 12 if person 12 performs an action (e.g., an action to help correct the readiness condition of device 14 that is no longer being met).

When device 14 includes an audible sound emitted during a notification period of status alert 18 that is formed, at least in part, by at least one spoken word, the at least one spoken word may be recorded at a factory, or the at least one spoken word may be recorded by person 12 after device 14 leaves the factory. In one example, device 14 includes a factory voice recording that is modifiable after leaving the factory. In other words, device 14 includes at least one factory recording while also allowing person 12 to record new voice recordings and customize the at least one spoken word emitted during a notification period of status alert 18. By allowing person 12 to record new voice recordings, audible sound emitted during a notification period of status alert 18 may be changed, e.g., to match a dialect of a local language spoken at the location of device 14 or to match the training level of person 12.

In some examples, status alert 18 may include a combination of a burst of tones and voice recordings. In one example, an audible sound emitted during a first notification period of status alert 18 may include a burst of tones and an audible sound emitted during a second notification period of status alert 18 may include at least one spoken word. In another example, audible sound emitted during a single notification period of status alert 18 may include at least one burst of tones and at least one spoken word. For example, an audible sound emitted during a notification period of status alert 18 may include a burst of tones to get the attention of person 12 and at least one spoken word immediately following the burst of tones to instruct person 12 or to inform person 12 of the readiness condition of device 14. Other combinations of bursts of tones and spoken words may be used to create status alert 18. By combining different sounds of the burst of tones and spoken words, device 14 may be configured to ensure that the attention of person 12 is successfully captured.

Independent of whether device 14 is configured to provide a burst of tones, at least one spoken word, or a combination of a burst of tones and spoken words, status alert 18 of device 14 may be modifiable by a person. Device 14 may include a user interface, which a planner or manufacturer or manager may use to configure various aspects of status alert 18. The user interface may include a set of buttons, a touch screen, a keypad, or some other method of accepting input from the planner. The planner may need to enter a password to modify a parameter of status alert 18 in order to prevent unauthorized persons from modifying the operation of device 14. In some examples, the planner 12 may configure status alert 18 through a separate programmer that communicates with device 14. The programmer may directly plug into a communication port of device 14 or communicate via wireless communication methods, such as radio frequency or infrared methods. Alternatively, device 14 may be set to factory settings to prevent person 12 from modifying status alert 18.

In examples where device 14 includes a user interface, the planner may use the user interface to program one or more parameters of status alert 18. In one example, the planner may use a user interface of device 14 to program the content of the audible sound(s) to be emitted during one or more notification periods of status alert 18. The planner may select specific audible sounds to be emitted in response to specific readiness conditions not being met, record one or more spoken words to be emitted during a notification, or otherwise modify the content of the audible sound(s) to be emitted during one or more notification periods of status alert 18. In another example, the planner may use a user interface of device 14 to program the content of a schedule of intended alert times for status alert 18. For example, the planner may program a time table for notification periods (and/or off periods) of status alert 18, thereby establishing the off periods and/or notification periods of status alert 18 once the alert is activated. In still another example, the planner may use a user interface of device 14 to program a parameter relating to enabling or inhibiting the emission of status alert 18. The parameter may allow device 14 to activate status alert 18 if device 14 determines that a readiness condition is no longer being met. Alternatively, the parameter may prevent device 14 from delivering status alert 18 even if device 14 determines that a readiness condition is no longer being met.

In some examples, device 14 may include different alerting mechanisms in addition to, or in lieu of, status alert 18. The different alerting mechanisms may be used to increase the chance of attracting the attention of person 12. For example, audible status alert 18 may be combined with one or more flashing lights (not shown) located on the exterior of device 14. The lights may be one or more light emitting diodes (LEDs) of one or more colors. The lights may remain on or the lights may blink, e.g., during the notification periods of status alert 18. During operation, the lights may help person 12 detect device 14 as requiring further attention. For example, person 12 may slightly hear audible sound during a notification period of status alert 18 and attempt to locate where the audible sound is originating from. Person 12 may see the lights of device 14 and then easily recognize that device 14 is producing audible sound.

The variable duty cycle of status alert 18 may enable device 14 to use less battery power in attempting to attract the attention of person 12 by not providing the audible sound when the person is not within the proximity of the device. To help detect the presence of person 12, and to improve the power conserving features of device 14, device 14 may include an additional or alternative mechanism that detects the possible presence of person 12. For example, device 14 may include one or more sensors (not shown) that sense an activity or combination of activities indicative of the presence of person 12. Activities that a sensor may sense include sound, light, vibration, and physical proximity.

The sensed activity may directly cause device 14 to activate status alert 18, e.g., beginning with a notification period so that audible sound is emitted from a sound producer of device 14 after sensing the activity. The sensed activity may also cause device 14 to modify a progressive cycle or scheduled cycle that controls how the duration of successive off periods (or notification periods) vary. For example, upon sensing activity, device 14 may store times of the day corresponding to the sensed activity. Device 14 may further modify one or more alert times that dictate how status alert 18 is delivered.

Device 14 may modify predetermined times for the notification periods of status alert 18 to correspond to times when activity was sensed by device 14, thus increasing the likelihood that person 12 will detect status alert 18 if person 12 follows a routine pattern. In another example, device 14, upon sensing activity, may restart a progressive cycle the controls the duration of successive off periods such that shorter off periods begin to attempt to get the attention of person 12. In other examples, a notification period of status alert 18 may be inhibited from occurring unless device 14 senses a threshold activity. Upon sensing a preset amount of activity, device 14 may begin issuing an audible sound associated with a notification period of status alert 18.

As mentioned previously, medical device 14 is stored at a storage location where a patient emergency may occur, which in the example of FIG. 1 is on wall 16. In different examples, device 14 may be on a shelf, on a table, in a drawer, in a medical response bag, or in any other suitable location. Because of the of the wide variety of locations in which device 14 may be placed, the power conserving techniques of this disclosure may help person 12 locate and identify device 14 for further attention should a need or problem arise with device 14.

What has been so far described as medical device 14 utilizing these power conserving techniques can be, in fact, any number of medical devices. For example, automated external defibrillators (AEDs), digital thermometers, electric stimulation devices, drug delivery devices, blood glucose monitors, external chest compression machines, CPR assist devices, or other devices may benefit from the described power conserving alert techniques of this description.

Figure 2:
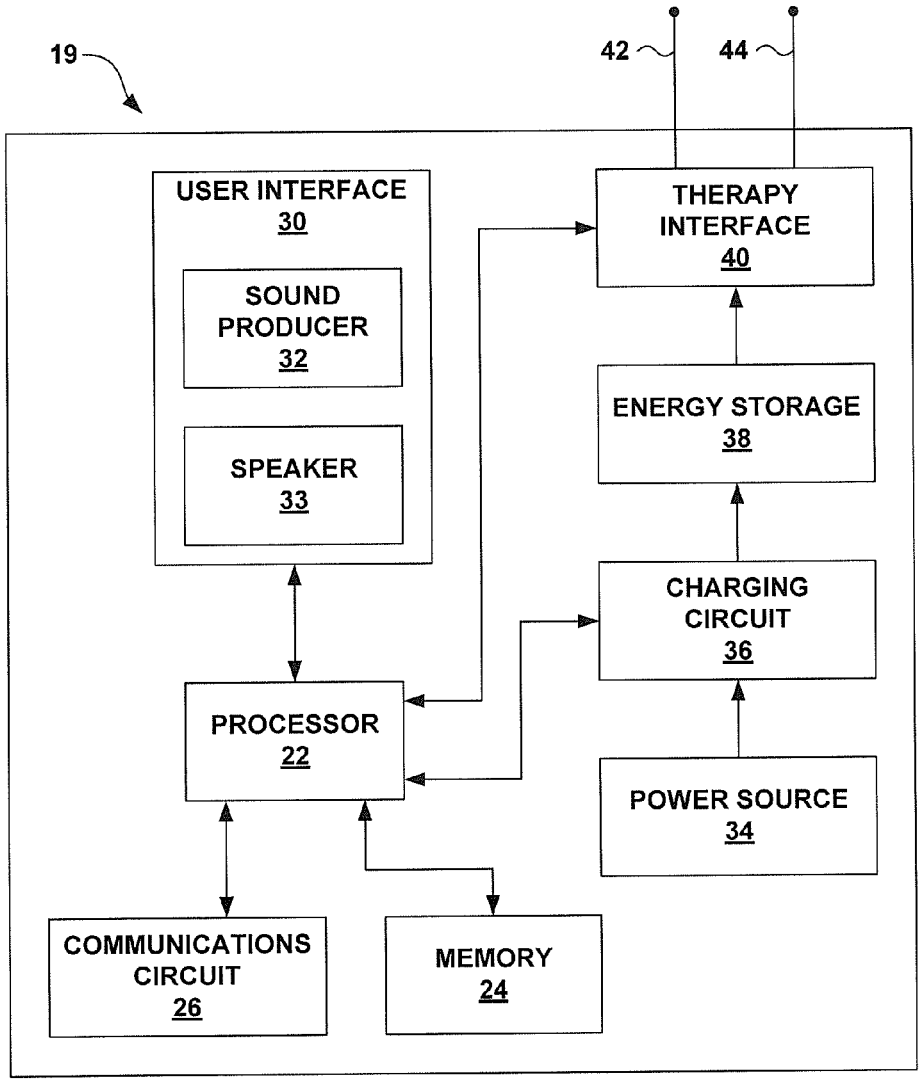
FIG. 2 is a functional block diagram illustrating components of an AED that could be the medical device of FIG. 1.

FIG. 2 is a functional block diagram illustrating various components of an AED 19, which could be medical device 14 in FIG. 1. As shown in FIG. 2, AED 19 includes processor 22, memory 24, power source 34, charging circuit 36, energy storage 38, therapy interface 40, user interface 30, sound producer 32, speaker 33, and communications circuit 26. Leads 42 and 44 are coupled to therapy interface 40.

Processor 22 controls the operations of AED 19 based upon instructions located in memory 24. Processor 22 controls charging circuit 36 to draw current from power source 34 to charge energy storage circuit 36. Processor 22 controls therapy interface 40 to detect electrical signals from a patient (not shown). Processor 22 also controls whether energy is delivered to a patient from energy storage circuit 36 as a defibrillation pulse, e.g., automatically upon detecting a cardiac event or in response to a user input. Processor 22 also provides prompts and other information to a user through speaker 33, and receives information and commands from the user through user interface 30. Processor 22 sends and receives information to or from other devices though communications circuit 26. Further, as will be discussed in greater detail below, processor 22 operates sound producer 32 of user interface 30 based upon the instructions stored within memory 24 related to status alert 18.

Memory 24 stores instructions that cause processor 22 to perform the functions attributed to AED 19 herein. Memory 24 may include one or more of a random access memory (RAM), read-only memory (ROM), electronically-erasable programmable ROM (EEPROM), flash memory, or the like. Memory 24 may be fixed within AED 26 or removable from the AED. Processor 22 may comprise one or more of a microprocessor, digital signal processor (DSP), application specific integrated circuit (ASIC), field-programmable gate array (FPGA), or other digital logic circuitry. In some examples, AED 19 may include separate memories, e.g., for storing patient data and operational instructions. In some examples, AED 19 may include separate processors such as, e.g., one or more processors for controlling the defibrillation functions of AED 19 and one or more separate processors for controlling status alert 18.

In general, therapy interface 40 may include a receptacle, and leads 42 and 44 plug into the receptacle. Therapy interface 40 may also includes a switch (not shown in FIG. 2) that, when activated, couples an energy storage circuit 38 to leads 42 and 44. Energy storage circuit 38 stores the energy to be delivered to the patient in the form of a defibrillation pulse. The switch may be of conventional design and may be formed, for example, of electrically operated relays. Alternatively, the switch may comprise an arrangement of solid-state devices such as silicon-controlled rectifiers or insulated gate bipolar transistors.

Energy storage circuit 38 includes components, such as one or more capacitors, that store the energy to be delivered to the patient via leads 42 and 44 and the electrodes at the distal ends of the leads (not shown). Before a defibrillation pulse may be delivered to the patient, energy storage circuit 38 may require charging. Processor 22 directs charging circuit 36 to charge energy storage circuit 38 to a high voltage level. Charging circuit 36 may include, for example, a flyback charger that transfers energy from power source 34 to energy storage circuit 38.

AED 19 may be a manual defibrillator instead of an automatic defibrillator as generally described herein. Where AED 19 is a manual defibrillator, a user using AED 19 may select an energy level for each defibrillation pulse delivered to the patient. Processor 22 may receive the selection made by the user via user interface 30, which may include input devices, such as a keypad and various buttons or dials, and output devices, such as various indicator lights, a cathode ray tube (CRT), light emitting diode (LED), or liquid crystal display (LCD) screen, and speaker 33. In some examples, user interface 30 may include a touch-sensitive display. Where AED 19 is automated, processor 22 may select an energy level from a preprogrammed progression of energy levels stored in memory 24 based on the number of defibrillation pulses already delivered to the patient.

When the energy stored in energy storage circuit 38 reaches the desired energy level, processor 22 controls user interface 30 to provide an indication to the user that AED 19 is ready to deliver a defibrillation pulse to a patient, such as a displayed indication or a voice prompt. The defibrillation pulse may be delivered manually or automatically. Where the defibrillation pulse is delivered manually, the user may direct processor 22 to deliver the defibrillation pulse via user interface 30 by, for example pressing a button. In either case, processor 22 activates the switches of therapy interface 40 to electrically connect energy storage circuit 38 to leads 42 and 44, and thereby deliver the defibrillation pulse to the patient.

Processor 22 may modulate or otherwise control the defibrillation pulse delivered to the patient. For example, processor 22 may control the switches of therapy interface 40 to regulate the shape and width of the pulse. In some examples, processor 22 may control the switches of therapy interface 40 to modulate the pulse to provide a multiphasic pulse, such as a biphasic truncated exponential pulse.

Processor 22 may perform other functions as well, such as, e.g., monitoring electrical activity of the heart of the patient sensed via leads 42 and 44. Processor 22 may determine whether the heart of the patient is fibrillating based upon the sensed electrical activity in order to determine whether a defibrillation pulse should be delivered to the patient. Where a defibrillation pulse has already been delivered, processor 22 may evaluate the efficacy of the delivered defibrillation pulse by determining if the heart is still fibrillating in order to determine whether an additional defibrillation pulse is warranted. Processor 22 may automatically deliver defibrillation pulses based on these determinations, or may advise the user of these determinations via user interface 30. In some examples, processor 22 may display an electrocardiogram (ECG) that reflects the sensed electrical activity via user interface 30.

Processor 22 may store an indication of the time of delivery of each defibrillation pulse delivered to the patient as patient data within memory 24. Processor 22 may also store the energy level of each pulse and other characteristics of each pulse, such as the width, amplitude, or shape, as patient data. Processor 22 may also store a digital representation of an ECG, or a heart rate over time, determined based on the electrical activity of the heart of the patient detected via electrodes 20 and 22 as patient data. Further, processor 22 may control delivery of other types of therapy to the patient via leads 42 and 44, such as cardioversion or pacing therapy. As with the delivery of a defibrillation pulse, processor 22 may store information describing the times that such therapies were delivered and parameters of such therapies, such as cardioversion pulse energy levels or pacing rates.

User interface 30 may include a microphone (not shown) that detects sounds in the vicinity of AED 19. Processor 22 may receive signals from the microphone and store an audio recording that includes these signals as patient data. The audio recording may include verbal notations of the user, or conversations between the user and the patient.

Communications circuit 26 may be used as an interface between AED 19 and another device, such as a programmer or computing device (not shown). Communication circuit 26 may also interface with a separate physiological parameter monitoring unit, which may monitor one or more physiological parameters of a patient and communicate the parameter data to AED 19 for use in determining a therapy to be delivered via therapy interface 40. Communications may be accomplished through wired or wireless connections. Wired communication connections may include a universal serial bus (USB), a FireWire connection (IEEE 1394), a serial connection, Ethernet connection, modem connection, or any other wired communication technique. Wireless communications may be accomplished by radio frequency (RF) or infrared communication, such as communication according to the Bluetooth, IEEE 802.11 or IRDA protocols.

Power source 34 delivers operating power to the components of AED 19. Power source 34 may include a battery and a power generation circuit to produce the operating power and therapy. In some examples, the battery may be rechargeable to allow extended operation. Recharging may be accomplished by drawing current from a standard alternating current electrical outlet, such as a 120 V outlet. In some examples, power source 34 may run directly off of an alternating current outlet.

When not in use, processor 22 may set AED 19 into a storage mode. In the storage mode, most functions of AED 19 are turned off to conserve battery power. A few diagnostic functions may, however, continue to operate so that processor 22 may identify a problem with AED 19 and alert user 12. In one example, all processes of AED 19 may shut down in storage mode except for processor 22, which may periodically perform a diagnostic check of AED 19. In another example, all processes of AED 19, including processor 22, shut down in storage mode except for a clock chip of AED 19. At scheduled intervals (e.g., weekly, monthly, quarterly, or the like) the clock chip wakes processor 22 up, and processor 22 in turn performs a diagnostic check. If processor 22 identifies a readiness condition of AED 19 that is no longer being met during a diagnostic check, processor 22 initiates status alert 18. Alternatively, if processor 22 does not identify a readiness condition of AED 19 that is no longer being met, processor 22 may shut down until the next scheduled diagnostic interval, at which time the clock chip will again wake processor 22 up. A clock chip may consume less power than processor 22 and, as such, may help AED 19 conserve power when AED 19 is in a storage mode.

Memory 24 includes instructions for processor 22 corresponding to status alert 18. Memory 24 may include instructions specifying a length, a volume, and a frequency for each tone in a burst of tones, as well as how many tones are included in a burst. Memory 24 may also include one or more voice recording (i.e., that each include one or more spoken words) to provide to person 12 through sound producer 32. The notification periods and off periods of status alert 18 are defined within memory 24 so that processor 22 correctly provides audible sounds during the notification periods of status alert 18 in a manner that conserves the power of power source 34.

User interface 30 may allow person 12 to review parameters of status alert 18 and configure the parameters of status alert 18 as the person desires. Changes to the specifications of status alert 18 are stored within memory 24 and used when processor 22 identifies a need to alert person 12 (e.g., when a readiness condition of AED 19 is no longer being met). Memory 24 may keep a log of the different status alerts configured by person 12 in order to review any changes made to AED 19. The log may be used to help determine how AED 19 became non-functional or failed to alert person 12.

User interface 30 also includes sound producer 32, which provides audible sound during the notification periods of status alert 18 to person 12 when AED 19 is not being used. Sound producer may include a speaker, a sonalert, or any other feature configured to provide audible sound during a notification period of status alert 18. Sound producer 32 may be located within a housing of AED 19 and may be able to produce a wide range of frequencies. Sound producer 32 may be capable is reproducing different tones or a human voice. Generally, sound producer 32 may produce frequencies between approximately 20 Hz and approximately 20,000 Hz, which is the normal range of frequencies that a human can detect. In some examples, however, sound producer 32 may be configured to produce a narrower range of frequencies, such as between approximately 200 Hz and approximately 14,000 Hz.

In some examples, AED 19 may use sound producer 32 during a patient emergency to provide audible sounds to a user of AED 19. Audible sounds may include instructions or command prompts to the user of AED 19 to sequentially guide the user through the operation of AED 19. Audible sounds may also provide instructions or command prompts guiding the user to provide additional or different therapies to the patient. For example, AED 19 may be configured to provide audible prompts to help the user perform Cardio Pulmonary Resuscitation (CPR) on the patient. The instructions may be stored in memory 24 of AED 19, and processor 22 may control sound producer 32 to emit the audible command prompts during a patient emergency.

In other examples, as illustrated in the example of FIG. 2, AED 19 may include speaker 33 in addition to or in lieu of sound producer 32. Speaker 33 may be an emergency speaker that AED 19 uses to provide audible sounds to a user of AED 19 during a patient emergency. In other words, AED 19 may use sound producer 32 to emit audible sound during a notification period of status alert 18 to attract the attention of person 12 while using speaker 33 to emit audible sounds (e.g., CPR command prompts) to a user of AED 19 during a patient emergency. Including a separate sound producer 32 and speaker 33 on AED 19 may allow the two features to be arranged on different locations of AED 19. For example, sound producer 32 may be located on an external surface of a case of AED 19 while speaker 33 may be located on an interior surface of AED 19 that is exposed upon opening the case of AED 19. This separate positioning may allow audible sound emitted from sound producer 32 to be detected by a person passing by AED 19 while allowing audible sound emitted from speaker 33 to be readily understood by a user of AED 19 during a patient emergency.

In some examples, an audible sound emitted during a notification period of status alert 18 may be emitted by both sound producer 32 and speaker 33. In some additional examples, AED 19 may utilize multiple sound producers in order to reproduce certain sounds or provide status alert 18 from more than one location of AED 19. For example, AED 19 may be stored on a shelf such that sound producer 32 is against a wall. Since sound producer 32 may fail at alerting person 12, a second sound producer located away from the wall may allow status alert 18 to reach the person. In some examples, sound producer 32 may operate independent of user interface 30.

Figure 3:
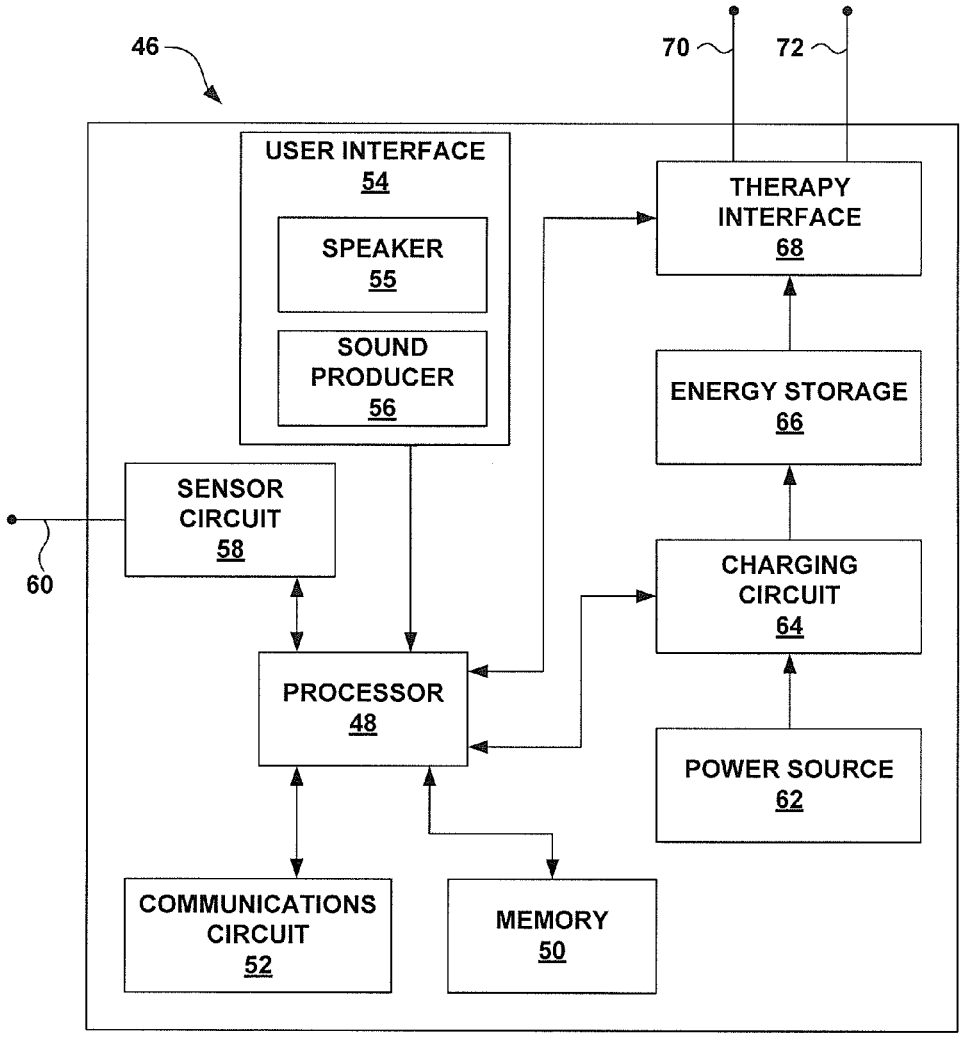
FIG. 3 is a functional block diagram illustrating components of an example AED including an activity sensor.

FIG. 3 is a functional block diagram illustrating various components of another example AED 46 that includes activity sensor circuit 58. As shown in FIG. 3, AED 46 includes processor 48, memory 50, communications circuit 52, user interface 54, speaker 55, sound producer 56, sensor circuit 58, power source 62, charging circuit 64, energy source 66, and therapy interface 68. Sensor 60 is coupled to sensor circuit 58 and leads 70 and 72 are coupled to therapy interface 68. AED 46 is substantially similar to AED 19. Components of AED 46 and AED 19 are also similar, with the exception of sensor circuit 58 and sensor 60.

When not in use, processor 48 may set AED 46 into a storage mode. In the storage mode, most functions of AED 46 may be turned off to conserve battery power. A few diagnostic functions may, however, continue to operate. For example, a clock chip of AED 46 may continue to operate. The clock chip may periodically wake processor 48 up, and processor 48 may perform a diagnostic check on AED 46 upon being awoken. During the diagnostic check, AED 46 may identify a readiness condition of AED 46 that is no longer being met. Upon identifying the readiness condition of AED 46 that is not being met, processor 48 initiates status alert 18. In addition to or in lieu of beginning status alert 18, AED 46 may activate sensing circuit 58, and in particular sensor 60, in an attempt to sense an activity of person 12. Upon sensing an activity indicative of the presence of person 12, AED 46 may initiate status alert 18, e.g., to provide an alert that includes audible sound during notification periods and alternating off periods between notification periods during which substantially no audible sound is emitted. In this way, sensing circuit 58 may aid in conserving battery power by further eliminating unnecessary audible sound when person 12 is not within the proximity of AED 46.

Sensing circuit 58 may support the function of sensor 60. Sensor 60 may detect at least one of light, sound, vibration, or proximity of a foreign mass (e.g., person 12. To detect light, sensor 60 may be a photoreceptor or photoelectric cell. To detect sound, sensor 60 may be a microphone. To detect vibration, sensor 60 may be an accelerometer, a gyroscope, or a motion detector. To detect the proximity of a foreign mass, sensor 60 may be a proximity sensor. AED 46 can include additional or different sensors, and it should be appreciated that power conserving devices according to this disclosure are not limited in this respect.

Sensor circuit 58 may compare a signal from sensor 60, e.g., to a predetermined threshold or a signal sample that corresponds to activity within an alert proximity of AED 46, to detect possible activity of person 12. For example, sensor 60 may sense that a light is turned on in a room or sense a vibration or motion from person 12 walking nearby. In some examples, sensing circuit 58 may calibrate a signal from sensor 60 at a predetermined schedule or upon sensing a low signal for a certain amount of time. In some examples, AED 46 may integrate more than one sensor to more accurately determine if person 12 is proximate to the AED. In this manner, sensor circuit 58 may support multiple sensors, or more than one sensor circuit may be included in AED 46.

Memory 50 includes instructions for processor 48 corresponding to status alert 18. Memory 50 may include a length, a volume, and a frequency of each tone in the burst of tones, as well as how many tones are included in the burst. Additionally, memory 50 may include one or more spoken words to provide to person 12 through sound producer 56. The notification periods and off periods of status alert 18 are defined within memory 50 so that processor 48 correctly provides audible sound during the notification periods of status alert 18 in a manner that conserves the power of power source 34.

If status alert 18 is being delivered when sensing circuit 58 senses an activity, processor 48 may alter the notification periods of status alert 18. In one example, processor 48 may restart a progressive cycle that controls the duration of successive off periods to provide for shorter off periods upon sensing an activity. In another example, processor 48 may modify a parameter of status alert 18 (e.g., a volume, frequency, and/or spoken word emitted during a notification period of status alert 18) upon sensing an activity. In yet another example, processor 48 may modify a schedule that controls how the duration of successive off periods (or notification periods) vary to correspond to the time(s) that the activity was sensed. For example, upon sensing activity, processor 48 may store a time of the day corresponding to the sensed activity in memory 50. Processor 48 may further modify one or more alert times that dictate how status alert 18 is delivered. Processor 48 may modify a schedule of predetermined times for the notification periods of status alert 18 to correspond to times when activity was sensed by AED 46. In some examples, processor 48 may attempt to predict a time that person 12 will be within an alert proximity of AED 46 based upon the sensed activity. In some examples, memory 50 may store a log of times when an activity was sensed, and processor 48 may modify status alert 18 only after an activity pattern is identified.

In other examples, processor 48 may wait to initiate status alert 18 until a preset amount of activity is detected. The preset amount of activity may correspond to an amount of activity sensed at one time. Alternatively, the present amount of activity may correspond to a cumulative amount of activity sensed over a given period of time.

User interface 54 may allow person 12 to review the parameters of status alert 18 and configure the parameters of status alert 18 as the person desires. Person 12 may also be able to configure thresholds for a sensed activity or provide a sample activity signal to AED 46. The sample activity signal may be a sample light, sound, vibration, or proximity signal consistent with a person's presence within the proximity of AED 46. Person 12 may also be able to configure how processor 48 modifies status alert 18 based upon a sensed activity. Changes to the specifications of status alert 18 may be stored within memory 50 and used when processor 48 identifies a readiness condition of AED 46 that is not being met. In other examples, by contrast, the factory settings of AED 46 may not be modified by person 12. Memory 50 may keep a log of the different status alerts configured by person 12 in order to review any changes made to AED 46. The log may be used to help evaluate AED 46 if AED 46 becomes non-functional or fails to alert person 12.

Figure 4:
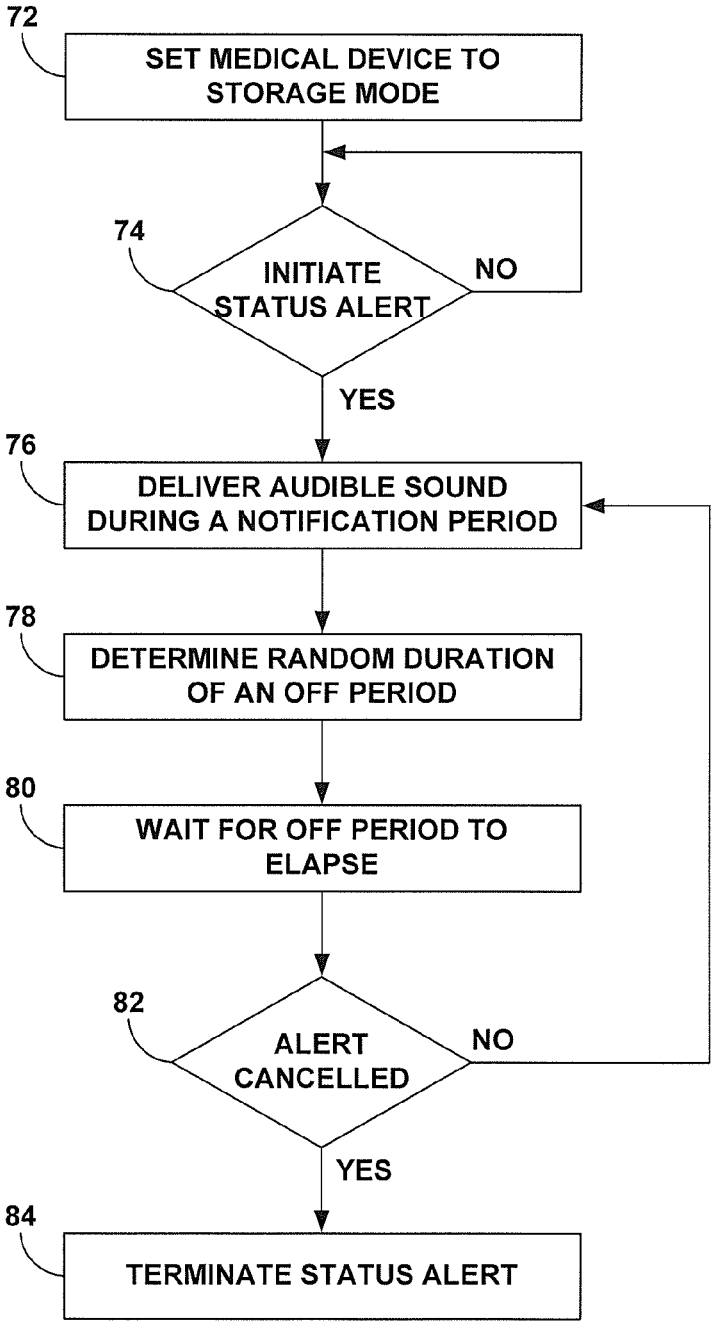
FIG. 4 is a flow diagram illustrating an example technique for delivering a status alert at randomly selected times.

FIG. 4 is a flow diagram illustrating an example technique for delivering audible sound during notification periods of status alert 18 at randomly selected times. For ease of description, the method of FIG. 4 is described with respect to medical device 14. In different examples, however, the method of FIG. 4 may be used with different medical devices, including AED 19 described with respect to FIG. 2, and AED 46 described with respect to FIG. 3. According to the method of FIG. 4, person 12 sets device 14 to storage mode when not in use (72). During storage mode, device 14 runs periodic diagnostic tests to identify any readiness conditions that are not being met by device 14. If processor 22 identifies a readiness condition that is not being met, processor 22 initiates status alert 18 (74). If processor 22 does not identify a readiness condition that is not being met, device 14 remains in storage mode (72). If processor 22 identifies a readiness condition that is not being met, processor 22 begins status alert 18 and emits audible sound from sound producer 32 during a notification period of status alert 18 (76).

Once status alert 18 is initiated, processor 22 determines a random duration for an off period to be provided between successive notification periods (78). Processor 22 then times the off period and waits for the off period to elapse (80). If the status alert has not been cancelled by either person 12 or processor 22 (82), processor 22 continues to deliver audible sounds during notification periods of status alert 18 (76). If the status alert has been cancelled (82), processor 22 terminates status alert 18 (84).

The off periods may have some limits, such as, e.g., a duration between 10 minutes in length to 24 hours in length. The randomly determined durations of the off periods of status alert 18 may have a non-random component. For example, the duration of an off period may be weighted such that the off period gradually increases during the duration of status alert 18. This component may be defined by person 12 or be a factory setting.

Figure 5:
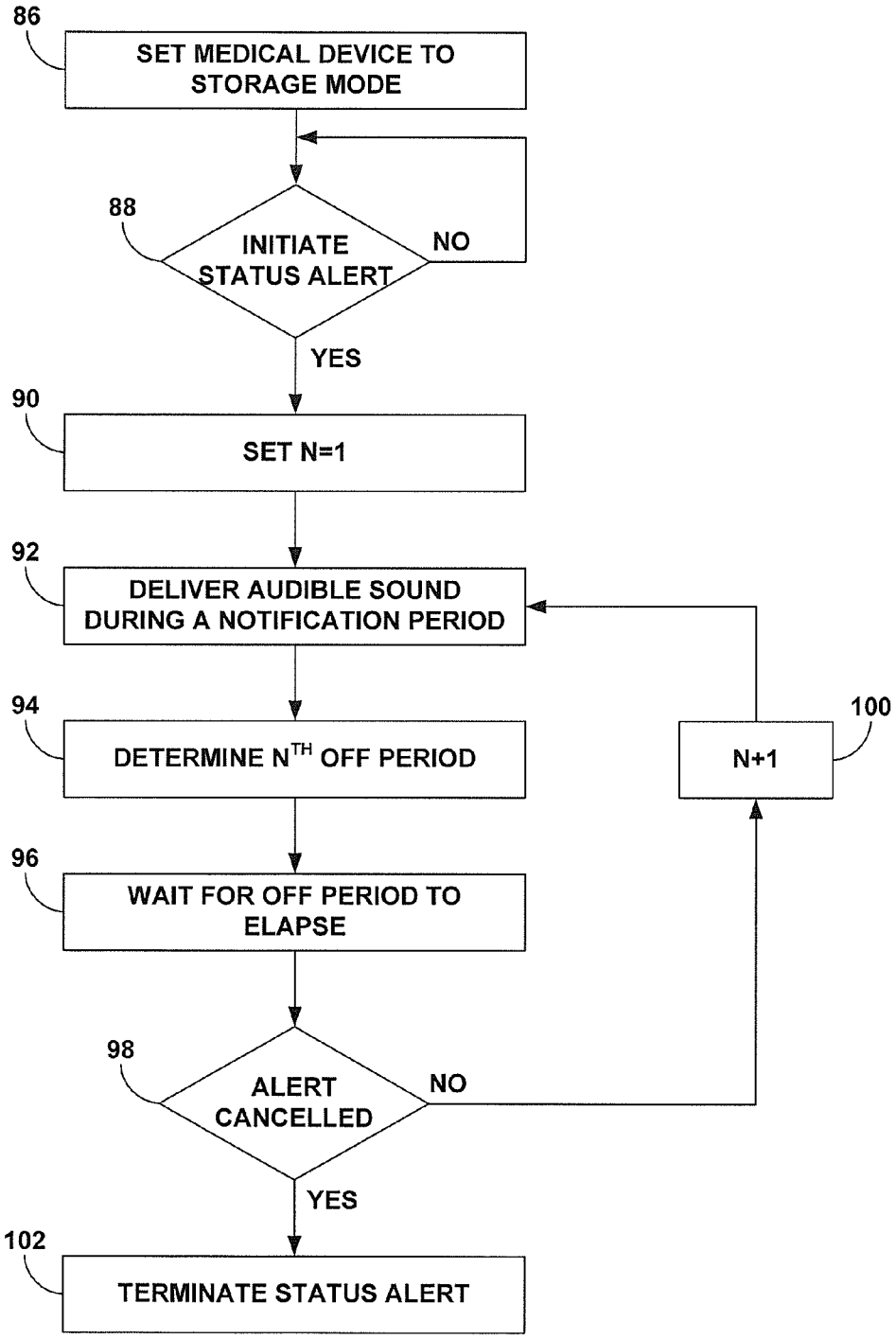
FIG. 5 is a flow diagram illustrating an example technique for delivering a status alert at progressively changing times.

FIG. 5 is a flow diagram illustrating an example technique for delivering audible sound during notification periods of status alert 18 at progressively changing times. As with FIG. 4, the technique of FIG. 5 is described with reference to device 14 for ease of description, although the technique is not limited in this respect. According to the example of FIG. 5, person 12 sets device 14 to storage mode when not in use (86). During storage mode, device 14 runs periodic diagnostic tests to identify any readiness conditions of device 14 that are not being met. If processor 22 identifies a readiness condition that is not being met, processor 22 initializes status alert 18 (88). If processor 22 does not identify a readiness condition that is not being met, device 14 remains in storage mode (86). If processor 22 identifies a readiness condition that is not being met, processor 22 begins status alert 18 and emits audible sound during a notification period of status alert 18 by setting a variable N equal to 1 (90). Variable N is used in determining the duration of the off periods of status alert 18.

Processor 22 controls sound producer 32 to emit audible sound during a notification period of status alert 18 immediately after beginning status alert 18 (92). Processor 22 then uses a formula to determine the duration of the Nth off period to be provided between the Nth and Nth+1 sequential notification periods of status alert 18 (94), where N begins at 1 and increases to 2, 3, 4, etc. In some examples, processor 22 may interrogate a look-up table to determine a duration of the Nth off period. Processor 22 then waits for the off period to elapse (96). If status alert 18 has not been cancelled by either person 12 or processor 22 (98), processor 22 adds one to the variable N so that the next progressive off period is determined by the processor (100). Processor 22 then continues to deliver audible sound during notification periods of status alert 18 (92). If the alert program has been cancelled, processor 22 terminates the status alert 18 (102).

The progressive variation of the duration of off periods of status alert 18 may be increasing or decreasing. The following is an example of an increasing progression of off periods of status alert 18 utilizing a 10 second burst of tones within a 5 minute prolonged burst. Processor 22 delivers a 10 second burst, followed by 20 seconds of silence, repeated for the first five minutes. An off period of 55 minutes follows the prolonged burst. This pattern continues for the first 24 hours of providing status alert 18. During the second 24 hour period, the off period is 1 hour and 55 minutes. During the third 24 hour period, the off period is 2 hours and 55 minutes. This progression continues for a predetermined number of days, when processor 22 then restarts the progression. In some examples, the predetermined number of days is not a multiple of seven days to avoid the same off periods occurring during the same days of the week. For example, the number of days may be 5 days or 8 days.

The following is another example of an increasing progression of off periods of status alert 18. Processor 22 delivers a 10 second burst of tones (e.g., a repeating beep-beep-beep), followed by 1 minute of silence, repeated for the 10 minutes. An off period of 1 hour follows the burst. This pattern continues for the first 24 hours of providing status alert 18. During the second 24 hour period, the off period is 2 hours. During the third 24 hour period, the off period is 3 hours. This progression continues for a predetermined number of days, when processor 22 then restarts the progression. It should be appreciated, however, that the foregoing description of an increasing progression of off periods is merely an example, and different cycles according to this disclosure are contemplated.

The off period may have some limits, such as, e.g., a duration between 10 minutes in length to 24 hours in length. The progressive off periods of status alert 18 may be defined by person 12 or may be a factory setting. Further, as described herein, the progressive off periods need not always progress to be defined as having increasing or decreasing off periods. Subsequent off periods may be equal in duration or the progression may be restarted.

Figure 6:
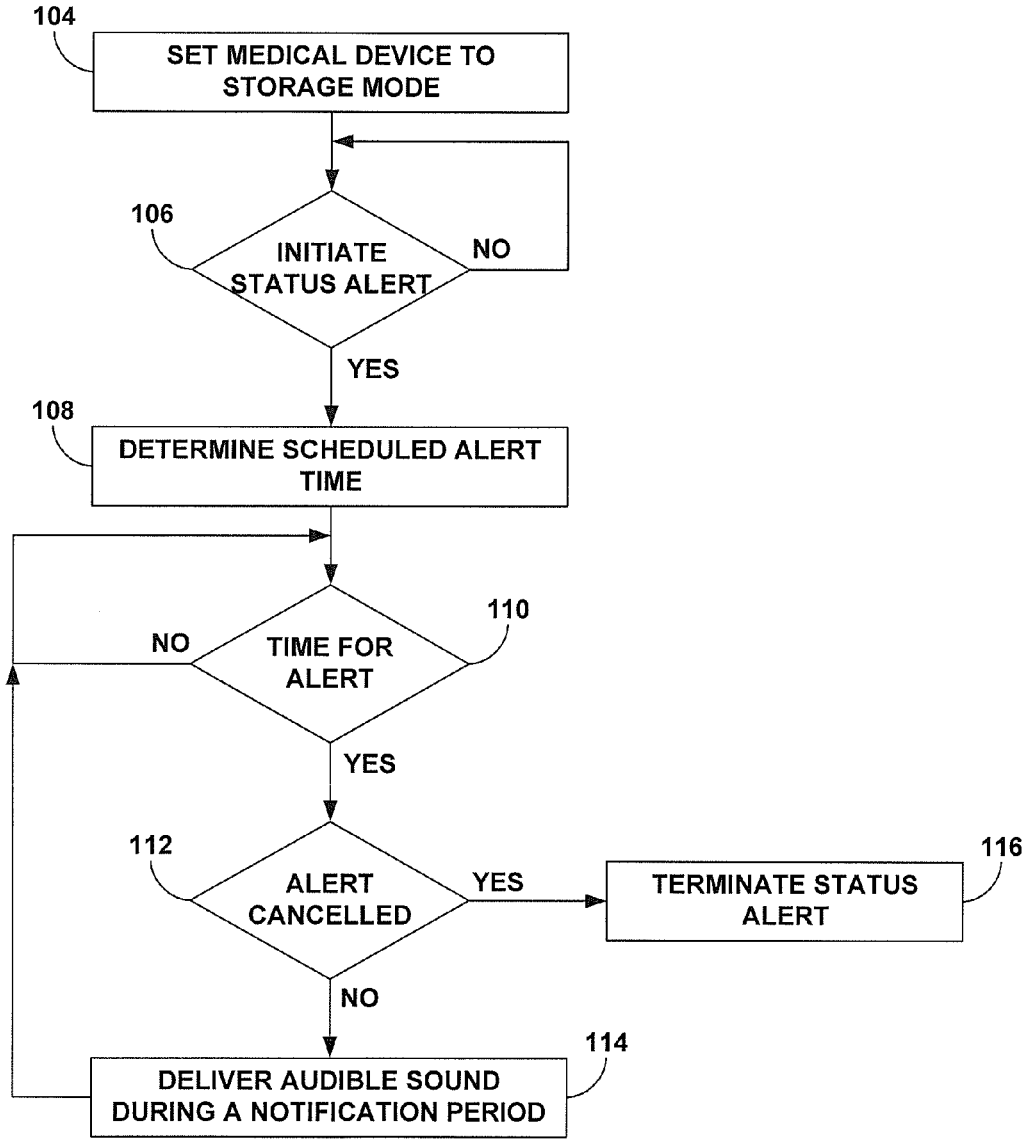
FIG. 6 is a flow diagram illustrating an example technique for delivering a status alert at scheduled times.

FIG. 6 is a flow diagram illustrating an example technique for delivering audible sound during notification periods of status alert 18 at scheduled times. As with FIGS. 4 and 5, the technique of FIG. 6 is described with reference to device 14 for ease of description, although the technique is not limited in this respect. According to the example of FIG. 6, person 12 sets device 14 to storage mode when not in use (104). During storage mode, device 14 runs periodic diagnostic tests to identify any readiness conditions of device 14 that are not being met. If processor 22 identifies a readiness condition of device 14 that is not being met, processor 22 initializes status alert 18 (106). If processor 22 does not identify a readiness condition of device 14 that is not being met, device 14 remains in storage mode (106). If processor 22 identifies a readiness condition of device 14 that is not being met, processor 22 determines a stored schedule of alert times and initiates status alert 18 according to a stored schedule (108). In different examples, the scheduled alert times may correspond to one or more times of a day or a predetermined pattern.

If processor 22 determines that the schedule does not provide for audible sound during a notification period of status alert 18 at the current time (110), processor 22 waits until the next scheduled alert time. Once processor 22 determines that it is time to provide audible sound during a notification period of status alert 18 (110), processor 22 checks if status alert 18 has been cancelled (112). If status alert 18 has not been cancelled, processor 22 provides audible sound during a notification period of status alert 18 (114) for the scheduled duration of the notification period and then waits for the next scheduled notification period. If status alert 18 has been cancelled (112), processor 22 terminates status alert 18 (116).

The scheduled notification periods or off periods of status alert 18 may vary daily, weekly, or monthly. In addition, the scheduled notification periods or off periods may vary based, e.g., on the day of the week. For example, the schedule may not provide a notification period on Saturday or Sunday if person 12 is not predicated to be within the alert proximity of device 14 on Saturdays and Sundays. To store predicted times and/or dates when person 12 is predicted to be within an alert proximity of device 14, person 12 may enter information via user interface 30 corresponding to times and/or dates (e.g., days of the week) when person 12 is expected to be in the proximity of device 14. Alternatively, predicted times may be preset in device 14, e.g., based on standard working hours, standard holidays, or the like.

Figure 7:
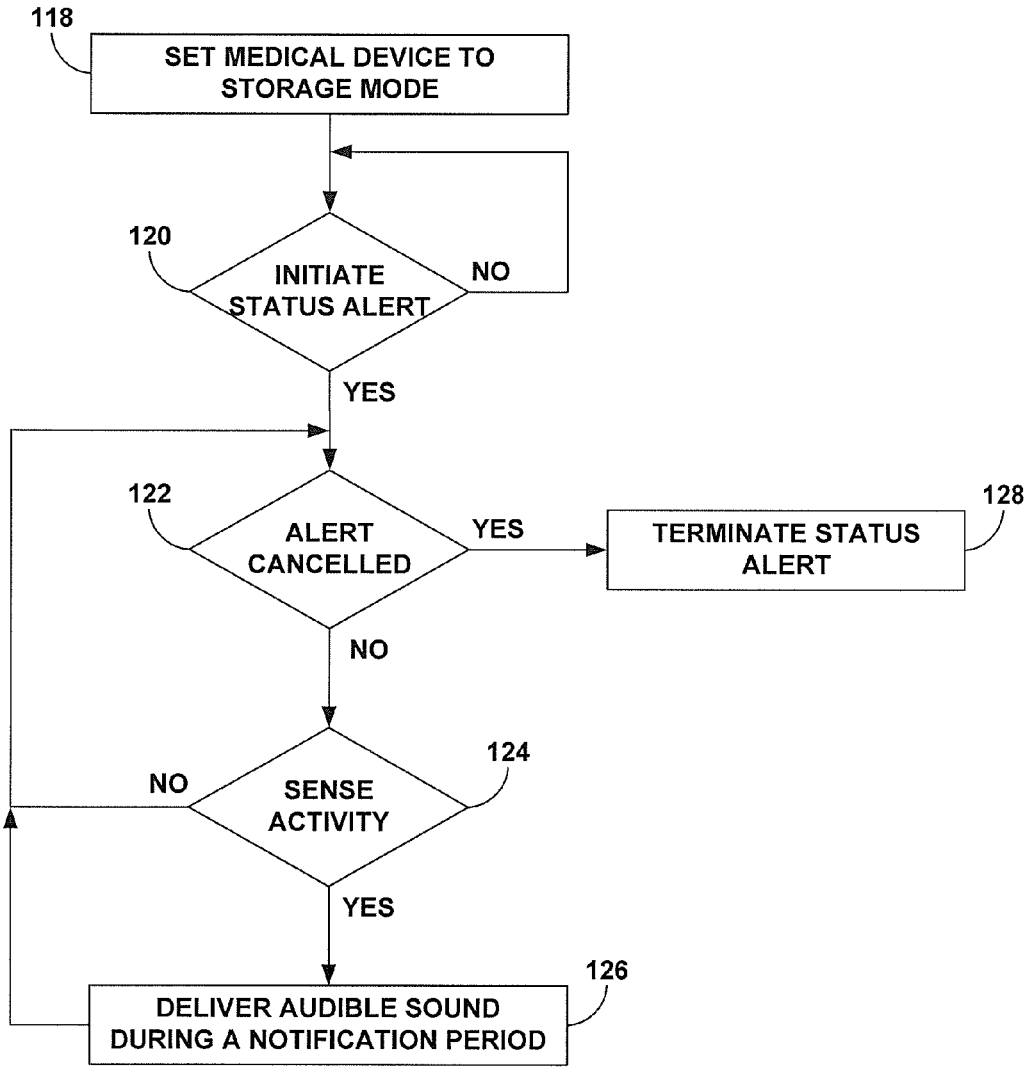
FIG. 7 is a flow diagram illustrating an example technique for delivering a status alert upon sensing an activity.

FIG. 7 is a flow diagram illustrating an example technique for delivering audible sound during a notification period of status alert 18 upon sensing an activity. The technique of FIG. 7 is described with reference to AED 46 (FIG. 3) for ease of description, although the technique is not limited in this respect. According to the example of FIG. 7, person 12 sets AED 46 to storage mode when not in use (118). During storage mode, AED 46 runs periodic diagnostic tests to identify any readiness conditions of AED 46 that are no longer being met. If processor 48 identifies a readiness condition of AED 46 that is no longer being met, processor 48 initializes status alert 18 (120). If processor 48 does not identify a readiness condition of AED 46 that is no longer being met, AED 46 remains in storage mode (118). If processor 44 identifies a readiness condition of AED 46 that is no longer being met, processor 48 checks if status alert 18 has been cancelled (122). If status alert 18 has not been cancelled, processor 48 activates sensing circuit 58 to sense activity within the sensing proximity if AED 46 (124). If there is no sensed activity, status alert 18 restarts by checking to see if status alert 18 has been cancelled (122).

When sensing circuit 58 senses activity with sensor 60, processor 48 delivers audible sound during a notification period of status alert 18 (126) and continues to check if the status alert has been cancelled (122). If status alert 18 has been cancelled (122), processor 48 terminates status alert 18 (128). In this manner, AED 46 conserves battery power by not providing audible sound during notification periods at unnecessary times.

In some examples, processor 48 may compare a sensed signal with information stored in memory 50 before initiating a notification period of status alert 18. In one example, processor 48 compares a sensed signal with a comparison signal stored in memory 50. In another example, processor 48 compares a sensed signal to a threshold stored in memory 50. For example, AED 46 may be configured to detect a predetermined number of sensed signals, frequency of sensed signals, or magnitude of a sensed signal of over a threshold signal before allowing processor 48 to provide audible sound during notification periods of status alert 18. For instance, sensing circuit 58 may need to detect a vibration more than two times a minute before indicating that there is activity associated with person 12. Activity sensing may be used in addition to, or in lieu of, any other techniques described in this disclosure to further decrease the amount of unneeded audible sound provide by an AED.

Figure 8:
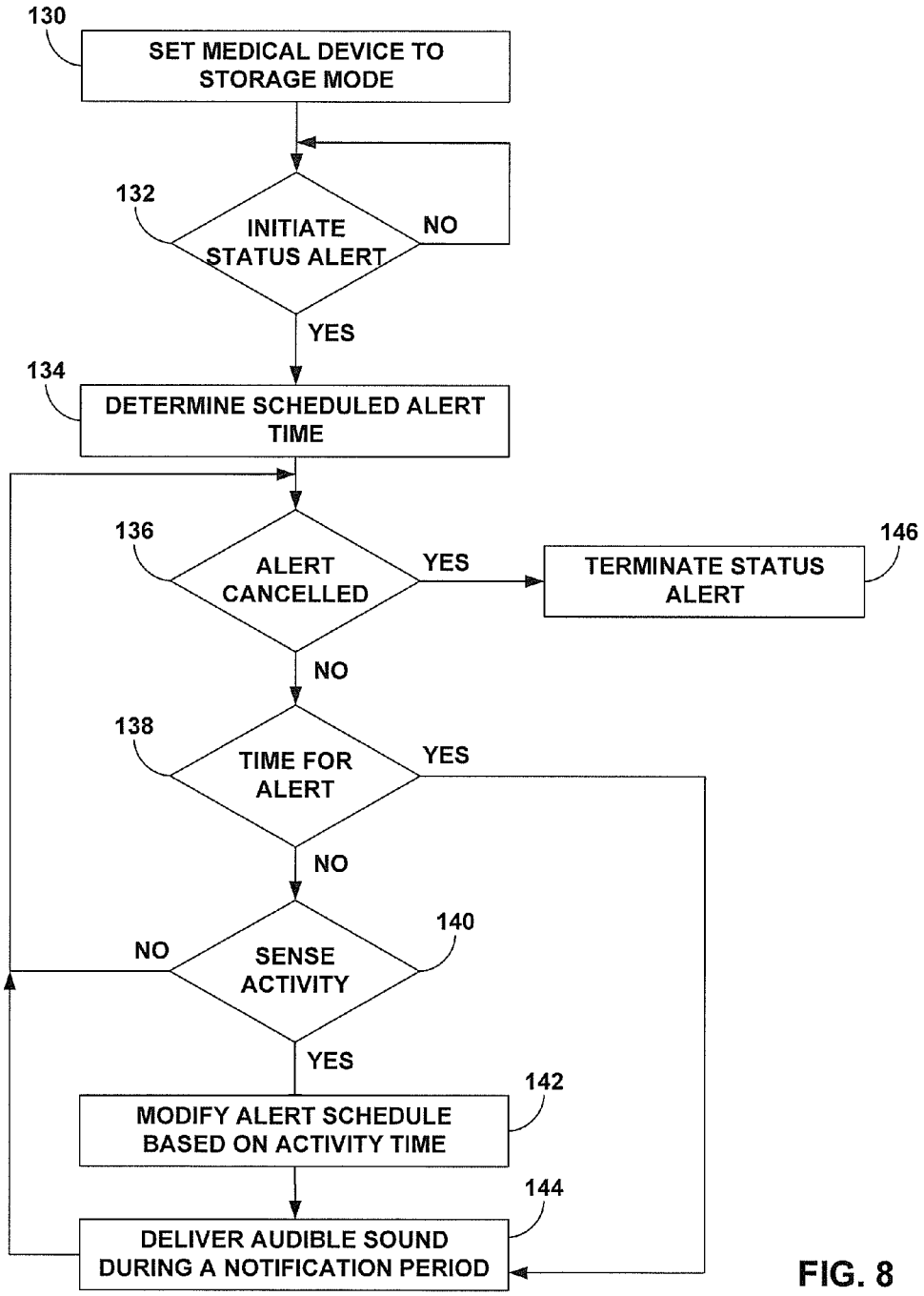
FIG. 8 is a flow diagram illustrating an example technique for modifying a status alert schedule based upon sensing an activity.

FIG. 8 is a flow diagram illustrating an example technique for modifying notification periods of status alert 18 based upon sensing an activity. As with FIG. 7, the technique of FIG. 8 is described with reference to AED 46 for ease of description, although the technique is not limited in this respect. According to the example of FIG. 8, person 12 sets AED 46 to storage mode when not in use (130). During storage mode, AED 46 runs periodic diagnostic tests to identify any readiness conditions of AED 46 that are no longer being met. If processor 48 identifies a readiness condition of AED 46 that is no longer being met, processor 48 initializes status alert 18 (132). If processor 48 does not identify a readiness condition of AED 46 that is no longer being met, AED 46 remains in storage mode (130). If processor 44 identifies a readiness condition of AED 46 that is no longer being met, processor 48 determines a stored schedule of notification periods and/or off periods and initiates status alert 18 according to the stored schedule (134). In different examples, the scheduled notifications periods and off periods may correspond to one or more times of a day or a predetermined pattern.

After determining the scheduled notification periods and off periods, processor 48 checks if status alert has been cancelled (136). If status alert 18 has not been cancelled, processor 48 determines if it is time to provide audible sound during a notification period of status alert 18 (138). If processor 48 determines that the next scheduled notification period of status alert 18 should be provided, processor 48 provides audible sound corresponding to the notification period (144). If the scheduled time has not been reached, processor determines if an activity has been sensed (140). If no activity has been sensed, processor 48 returns to the beginning of the cycle. If processor 48 senses an activity, processor 48 modifies the schedule such that the notification periods of status alert 18 are occur at the time the activity was sensed (142). Processor 48 promptly delivers audible sound during a notification period of status alert 18 (144) and begins the cycle again.

Processor 48 continues to check if status alert 18 has been cancelled (136). If status alert 18 has been cancelled, processor 48 terminates status alert 18 (146). In this manner, AED 46 conserves battery power by updating a schedule used to provide audible sound during notification periods of status alert 18. In other examples, processor 48 may continue to monitor any trends associated with times of sensed activities and change the schedule accordingly.

While in the preceding examples AEDs 19 and 46 were described as including processors 22 and 48, respectively, in other applications according to the disclosure, an AED may include one or more processors performing the functions individually attributed to processors 22 and 48.

In one example, an AED may include a battery that has a processor that is separate from a main processor of the AED (e.g., processor 22 or 48). The battery processor may perform regular battery self tests of the battery charge level. The battery processor may also activate and control status alert 18 upon identifying a readiness condition that is no longer being met. This may allow the main AED processor to remain in a storage mode to conserve battery power.

In another example, an AED may include a main processor and a separate watchdog processor that includes a real time clock. The watchdog processor may periodically wake the main processor up to diagnose the operational integrity of the main processor. The watchdog processor may also perform a diagnostic check on one or more components of the AED to determine if a readiness condition of the AED is no longer being met. In some examples, the watchdog processor may activate and control status alert 18 upon identifying a readiness condition that is no longer being met. The watchdog processor may consume less power than the main processor of the AED and, in this respect, may provide an energy efficient means for monitoring a readiness condition of the AED and controlling status alert 18.

In additional examples, an AED may include multiple processors performing different functions such as monitoring different readiness conditions of the AED and controlling different aspects of status alert 18. For example, the AED may include a controlling circuit with a controlling processor that is configured to control the notification periods and off periods of status alert 18. The controlling processor may consume less power than a main AED processor. In some examples, the main AED processor may still perform periodic diagnostic checks (e.g., daily, weekly, monthly, or the like) to determine if any readiness conditions of the AED are no longer being met. In other examples, supporting processors associated with specific AED components may perform diagnostic checks on the associated components to determine if a readiness condition is no longer being met. In either set of examples, the controlling processor may be configured to control the AED sound producer and status alert 18. This main allow the main AED processor to remain in a sleep mode while the AED delivers status alert 18.

Independent of the specific number or arrangement of processors in an AED according to the disclosure, the described techniques may be implemented, at least in part, in hardware, software, firmware or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" may generally refer to any of the foregoing logic circuitry, alone or in combination with other logic circuitry, or any other equivalent circuitry. A control unit comprising hardware may also perform one or more of the techniques of this disclosure.

Different examples have been described. Various modifications may be made to the described examples without departing from the scope of the claims. These and other examples are within the scope of the following claims.

The invention claimed is:

1. A medical device for use in a patient emergency, the device capable of providing information related to at least one readiness condition about a suitability of the device for the use and intended to be stored at a storage location, the medical device comprising:

a battery;

a sound producer powered by the battery; and a processor configured to:

determine whether the at least one readiness condition is no longer met after having determined that the at least one readiness condition has been met for a first certain time period while being stored at the storage location, and cause, in response to so determining, the sound producer to emit an audible status alert including notification periods during which an audible sound is emitted alternating with off periods during which substantially no audible sound is emitted, the durations of two successive off periods being unequal to each other.

2. The medical device of claim 1, further comprising a user interface for receiving a parameter of the status alert.

3. The medical device of claim 2, in which the parameter is one of a content of the alert during one of the notification periods, a time table for the notification periods, or a program for at least one of enabling and inhibiting the emission of the alert.

4. The medical device of claim 1, further comprising:

an emergency speaker separate from the sound producer, in which the processor is further configured to cause audible prompts to be emitted via the emergency speaker for helping a user while performing Cardiopulmonary Resuscitation on a patient according to the audible prompts.

5. The medical device of claim 1, further comprising:

a stored schedule of intended notification periods, in which the processor is further configured to control the sound producer according to the stored schedule.

6. The medical device of claim 5, in which the notification periods are based upon times that a person is predicted to be close to the location.

7. The medical device of claim 5, in which the notification periods occur more frequently during daytime than nighttime.

8. A medical device for use in a patient emergency, the device capable of providing information related to at least one readiness condition about a suitability of the device for the use and intended to be stored at a storage location, the medical device comprising:

a battery;

a sound producer powered by the battery; and a processor configured to:

determine whether the at least one readiness condition is no longer met after having determined that the at least one readiness condition has been met for a first certain time period while being stored at the storage location, and cause, in response to so determining, the sound producer to emit an audible status alert including notification periods during which an audible sound is emitted alternating with off periods during which substantially no audible sound is emitted.

9. The medical device of claim 8, further comprising:

an activity circuit for sensing an amount of activity indicating that a person is close to the storage location, in which the activity circuit signals the processor to inhibit a notification period unless the activity circuit senses at least a preset amount of activity.

10. The medical device of claim 9, in which the activity circuit includes a microphone.

11. The medical device of claim 9, in which the activity circuit is configured to sense at least one of the group consisting of light, vibration, sound and proximity of a foreign mass.

12. The medical device of claim 8, further comprising:

an activity circuit for sensing an amount of activity indicating that a person is close to the storage location, in which a parameter of the status alert during a notification period is changed responsive to the sensed amount of activity.

13. The medical device of claim 12, in which the parameter includes at least one of the group consisting of a frequency, a volume, and a spoken word of the status alert.

14. A method for alerting a user that a medical device intended to be stored at a storage location does not meet at least one readiness condition about a suitability of the device for use, the method comprising:

determining whether the at least one readiness condition is no longer met after having been determined that the at least one readiness condition has been met for a first certain time period while being stored at the storage location; and causing, in response to determining the at least one readiness condition is no longer met, a sound producer to emit an audible status alert including notification periods during which an audible sound is emitted alternating with off periods during which substantially no audible sound is emitted.

15. The method of claim 14, further comprising performing a diagnostic check to determine whether the at least one readiness condition is no longer met.

16. The method of claim 14, further comprising controlling the sound producer according to a stored schedule of intended alert times.

17. The method of claim 16, further comprising:

sensing an amount of activity indicating that a passerby is close to a storage location during a second certain period of time;

registering the time of day that the passerby is indicated as being close to the storage location; and adjusting the intended alerting times from the registered time of day.

18. The method of claim 14, further comprising:

sensing an amount of activity indicating that a person is close to the storage location; and changing a parameter of the status alert during a notification period in response to the sensed amount of activity.

19. The method of claim 14, further comprising:

sensing an amount of activity indicating that a person is close to the storage location; and inhibiting a notification period from occurring unless a preset amount of activity is sensed.

20. The method of claim 14, in which the durations of two successive off periods are unequal to each other.

* * * * *